US006617288B1

(12) United States Patent
Mathur et al.

(10) Patent No.: US 6,617,288 B1
(45) Date of Patent: Sep. 9, 2003

(54) AQUEOUS COMPOSITIONS CONTAINING THIOPHOSPHORUS ESTERS OR THEIR SALTS WITH A OXYALKYLENE GROUP, AND METHODS OF USING THE SAME

(75) Inventors: Naresh Chand Mathur, Highland Heights, OH (US); Edward J. Konzman, Eastlake, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/074,902

(22) Filed: May 8, 1998

(51) Int. Cl.[7] ..... C10M 141/02; C10M 141/10

(52) U.S. Cl. ..... 508/431; 508/291; 508/501; 508/555; 508/562; 508/579; 508/583; 528/584

(58) Field of Search ..... 508/431, 291, 508/555, 562, 579, 583, 584, 501; 72/42

(56) References Cited

U.S. PATENT DOCUMENTS

| | | | | | |
|---|---|---|---|---|---|
| 2,905,683 | A | | 9/1959 | Goldsmith | 260/429.7 |
| 3,214,423 | A | * | 10/1965 | Zech et al. | 508/431 |
| 3,337,754 | A | | 8/1967 | Cyba | 260/950 |
| 3,340,329 | A | * | 9/1967 | Guarnaccio et al. | 508/431 |
| 3,359,347 | A | | 12/1967 | Cyba | 260/925 |
| 3,580,849 | A | * | 5/1971 | Geymayer et al. | 508/431 |
| 4,044,032 | A | | 8/1977 | Wiley et al. | 260/399 |
| 4,259,192 | A | | 3/1981 | Lilburn | 252/32.7 |
| 4,526,697 | A | | 7/1985 | Cox | 252/75 |
| 4,579,672 | A | | 4/1986 | Brecker et al. | 252/49.8 |
| 4,599,191 | A | | 7/1986 | Horodysky | 252/32.5 |
| 4,758,359 | A | * | 7/1988 | Kirk et al. | 508/431 |
| 4,774,351 | A | | 9/1988 | Fosberg | 558/207 |
| 4,797,229 | A | | 1/1989 | Frentrup et al. | 252/345 |
| 4,814,097 | A | | 3/1989 | Cardis | 252/46.6 |
| 4,997,968 | A | | 3/1991 | Burjes et al. | 558/120 |
| 5,342,531 | A | | 8/1994 | Walters et al. | 252/32.5 |
| 5,567,341 | A | | 10/1996 | Tury | 508/436 |
| 5,622,923 | A | * | 4/1997 | Mathur et al. | 508/431 |
| 5,744,432 | A | * | 4/1998 | Barnhorst et al. | 508/431 |

FOREIGN PATENT DOCUMENTS

| | | |
|---|---|---|
| DE | 1570654 | 5/1970 |
| EP | 523561 | 7/1992 |
| EP | 551760 | 12/1992 |
| WO | 9403462 | 2/1994 |

OTHER PUBLICATIONS

Smalheer, C.V. and R.K. Smith; Lubricant Additives; Lezius–Hiles Co., Cleveland, Ohio, Mar. 1967.

EP 96 30 4409; European Search Report mailed Jul. 2, 1997.

* cited by examiner

*Primary Examiner*—Jacqueline V. Howard
(74) *Attorney, Agent, or Firm*—Teresan W. Gilbert; William C. Tritt

(57) ABSTRACT

This invention relates to an aqueous composition comprising water, a surfactant or thickener, and at least one metal-free thiophosphorus acid ester, at least one amine salt of the thiophosphorus acid ester, or a mixture thereof, wherein the thiophosphorus acid ester contains at least one hydrocarbyl terminated oxyalkylene group, at least one hydrocarbyl terminated polyoxyalkylene group, or a mixture thereof. The aqueous compositions have improved antiwear/extreme pressure properties and improved antioxidation properties. In these compositions, the thiophosphorus acid esters and their salts act as antiwear agents and rust inhibitors.

26 Claims, No Drawings

AQUEOUS COMPOSITIONS CONTAINING THIOPHOSPHORUS ESTERS OR THEIR SALTS WITH A OXYALKYLENE GROUP, AND METHODS OF USING THE SAME

TECHNICAL FIELD OF THE INVENTION

This invention relates to aqueous compositions which contain a metal free thiophosphorus acid ester or salts thereof which contain at least one hydrocarbyl terminated oxyalkylene group and methods of using the same.

BACKGROUND OF THE INVENTION

An ongoing problem in the area of lubricating machinery is improving the water based lubricant's ability to prevent metal-on-metal contact. Previously, phosphorus esters were used, often in combination with other additives, to provide antiwear and extreme pressure protection to lubricants. It would be advantageous to have additives which improve the antiwear and extreme pressure protection of the aqueous lubricants.

SUMMARY OF THE INVENTION

This invention relates to an aqueous composition comprising water, a surfactant or thickener, and at least one metal-free thiophosphorus acid ester, at least one amine salt of the thiophosphorus acid ester, or a mixture thereof, wherein the thiophosphorus acid ester contains at least one hydrocarbyl terminated oxyalkylene group, at least one hydrocarbyl terminated polyoxyalkylene group, or a mixture thereof. The aqueous compositions have improved antiwear/extreme pressure properties and improved antioxidation properties. In these compositions, the thiophosphorus acid esters and their salts act as antiwear agents and rust inhibitors.

DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g. pyridyl, furyl, thienyl, imidazolyl, etc.

In general, no more than about 2, preferably no more than one heteroatom substituent will be present for every ten carbon atoms in the hydrocarbyl group. Typically, there will be no such heteroatom substituents in the hydrocarbyl group. Therefore, the hydrocarbyl group is hydrocarbon.

The thiophosphorus acid ester is generally present in an amount to improve the antiwear or extreme pressure properties of the aqueous compositions. In one embodiment, the thiophosphorus acid ester is present in an amount from about 0.01% up to about 10%, or from about 0.05% or up to about 4%, or from about 0.08% up to about 3%, or from 0.1% to about 2% by weight. Here, as well as elsewhere in the specification and claims, the range and ratio limits may be combined.

Thiophosphorus Acid Esters

As described above, the thiophosphorus acid ester has at least one group which is a hydrocarbyl terminated oxyalkylene group, or salts of the thiophosphorus acid esters. In one embodiment, the thiophosphorus acid esters are free of metal, e.g. ashless. The thiophosphorus acid esters or their salts may have one, two or three hydrocarbyl terminated oxyalkylene groups. Preferably, the thiophosphorus acid esters or salts have one or two, more preferably two hydrocarbyl terminated oxyalkylene groups, or a mixture of compounds having one, two or three hydrocarbyl terminated oxyalkylene groups. In one embodiment, the thiophosphorus acid esters and/or the aqueous compositions are free of dithiophosphorus acid esters and their salts, such as metal (e.g. zinc) or amine salts.

The hydrocarbyl moiety of the hydrocarbyl terminated oxyalkylene group generally contains up to about 30, or up to about 24, or up to about 18 carbon atoms. The hydrocarbyl moiety typically contains at least 1, or at least about 6, or at least about 8 carbon atoms. Examples of hydrocarbyl moieties include octyl, nonyl, decyl, dodecyl, tridecyl, tetradecyl, pentadecyl, hexadecyl, heptadecyl, octadecyl, nonadecyl, eicosyl, docosyl, tetracosyl, etc. In one embodiment, the hydrocarbyl moiety is free of sulfur. In another embodiment, the hydrocarbyl moiety is aliphatic.

The oxyalkylene moiety typically contains from 1 to about 18 carbon atoms, preferably from about 2 to about 8, more preferably two or three carbon atoms. The hydrocarbyl terminated oxyalkylene group may contain from one to about 40 oxyalkylene moieties. In one embodiment, the hydrocarbyl terminated oxyalkylene group has from about 2 to about 15, or from about 2 to about 10, or from about two to about three oxyalkylene moieties. In one embodiment, the number of oxyalkylene groups is an average. In one embodiment, the oxyalkylene groups are derived from alkylene oxides, such as those described herein (e.g. ethylene oxide, propylene oxide, butylene oxide, etc.)

Hydrocarbyl terminated oxyalkylene groups are derived from hydrocarbyl terminated oxyalkylenes. The hydrocarbyl terminated oxyalkylene may be prepared by treatment of an alcohol, a phenol, an amine, such as those discussed below, including a monoamine, or a mercaptan, such as a $C_{1-30}$ or $C_{1-18}$ mercaptan, with at least one alkylene oxide, preferably an alkylene oxide having from one to about eight carbon atoms. Examples of alkylene oxides include ethylene oxide, propylene oxide, and butylene oxide. Preferably the hydrocarbyl terminated oxyalklyene is an alkyl terminated oxyalkylene. The alkyl terminated polyoxyalkylenes are available commercially under such trade names as "CARBOWAX®" and "TERGITOL®" from Union Carbide, "TRITON®" from Rohm & Haas Company, "ALFONIC®" from Vista Chemicals Company, "GENEPOL®" from Hoechst Celanese Corporation, and "NEODOL®" from Shell Chemical Company. The TERGITOLS are identified as polyethylene glycol ethers of primary or secondary alcohols. Particularly preferred TERGITOL alkyl terminated oxyalkylenes are the TERGITOL® 15-S Series of secondary polyethylene glycol ethers. Examples of this series include TERGITOL 15-S-3, TERGITOL 15-S-5, TERGITOL 15-S-7, TERGITOL 15-S-9, TERGITOL 15-S-12, TERGITOL 15-S-15, TERGITOL 15-S-20, TERGITOL 15-S-30, and TERGITOL 15-S-40, wherein the last number of the series refers the average number of oxyethylene moieties in the ethers. The GENAPOL ethoxylated alcohols are synthetic or natural linear alcohols which are treated with ethylene oxide. An example of one of these alcohols is GENAPOL® 24-L-3, which is a $C_{12-14}$ synthetic alcohol treated with about three moles of ethylene oxide. The TRITON materials are identified generally as polyethoxylated alcohols or phenols. The ALFONIC materials are identified as ethoxylated linear alcohols which may be represented by the general structural formula, $$CH3(CH2)_dCH2(OCH2CH2)_eOH,$$

wherein d varies between 4 and 16 and e is a number between about 3 and about 11. Specific examples of ALFONIC® ethoxylates characterized by the above formula include ALFONIC 1012-60 wherein d is about 8 to 10 and e is an average of about 5 to 6; ALFONIC 1214-70 wherein d is about 10–12 and e is an average of about 10 to about 11; ALFONIC 1412-40, wherein d is about 10–12 and e is an average of about 2.5; ALFONIC 1412-60 wherein d is from 10-12 and e is an average of about 7; and ALFONIC 1218-70 wherein d is about 10–16 and e is an average of about 10 to about 11.

The NEODOL® ethoxylates are ethoxylated alcohols wherein the alcohols are a mixture of alcohols containing from about 12 to about 15 carbon atoms, and the alcohols are partially branched chain primary alcohols. The ethoxylates are obtained by reacting the alcohols with an excess of ethylene oxide, such as from about 3 to about 12 or more moles of ethylene oxide per mole of alcohol. For example, NEODOL ethoxylate 23–6.5 is a partially branched chain alcoholate of 12 to 13 carbon atoms with an average of about 6 to about 7 ethoxy units.

In one embodiment, the metal-free thiophosphorus acid ester is represented by the following formula

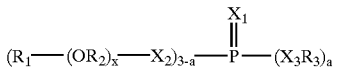

wherein $X_1$, $X_2$, and $X_3$ are oxygen or sulfur, provided that at least one of $X_1$, $X_2$, and $X_3$ is sulfur; $R_1$ is a hydrocarbyl group; $R_2$ is an alkylene group; $R_3$ is hydrogen or a hydrocarbyl group; x is a number from 1 to about 40; and a is 0, 1, or 2, or at least one salt of the thiophosphorus acid ester. In one embodiment, $X_1$ is sulfur, and $X_2$ and $X_3$ are oxygen and a is one. $R_1$ and $R_3$ each independently the same as the description of the hydrocarbyl moiety above. The values for x are the same the number of oxyalkylene groups described above.

The thiophosphorus acid ester which contains at least one hydrocarbyl terminated oxyalkylene group may be prepared by transesterifying a phosphite with one or more oxyalkylene containing compounds. In one embodiment, the thiophosphorus acid esters are prepared in the absence of unsaturated fatty acids or esters. The resulting intermediate is reacted with sulfur or a sulfur source. The phosphite may be a di- or trihydrocarbyl phosphite. Preferably each hydrocarbyl group contains from 1 to about 24 carbon atoms, more preferably from 1 to about 18 carbon atoms, and more preferably from 1 to about 8 carbon atoms. Each hydrocarbyl group may be independently alkyl, alkenyl, or aryl, preferably alkyl.

The sulfur source may be any of a variety of materials which are capable of supplying sulfur to the reaction. Examples of useful sulfur sources include sulfur, sulfur halides, combinations of sulfur with hydrogen sulfide or sulfur oxide with hydrogen sulfide, and various sulfur containing organic compounds. Elemental sulfur is a preferred sulfur source. The sulfur halides include sulfur monochloride, sulfur dichloride, etc. The sulfur sources may also be sulfur containing organic compounds, such as aromatic and alkyl sulfides, dialkenyl sulfides, sulfurized olefins, sulfurized oils, sulfurized fatty acid esters, sulfurized aliphatic esters of olefinic mono- or dicarboxylic acids, diester sulfides, sulfurized Diels-Alder adducts and sulfurized terpenes. U.S. Pat. No. 4,755,311 discloses various sulfur sources capable of supplying sulfur to reaction. This patent is incorporated by reference for its disclosure of sulfur sources. The preparation of monothiophosphoric acid esters is disclosed in U.S. Pat. No. 4,755,311 and PCT Publication WO 87/07638, which are incorporated herein by reference for their disclosure of monothiophosphoric acids, sulfur sources, and the process for making monothiophosphoric acid esters.

As described above, salts of the thiophosphorus acid esters having at least one hydrocarbyl terminated oxyalkylene group may be used in the aqueous composition. The salts are formed by reacting the thiophosphorus acid ester with ammonia or an amine. The salts may be formed separately and then added to the lubricating composition. Alternatively, the salts may also be formed in situ when an acidic thiophosphorus acid ester is blended with other components to form a fully formulated lubricating composition. The phosphorus acid ester may then form salts with basic materials which are in the lubricating composition or functional fluid composition such as basic nitrogen containing compounds (e.g., basic nitrogen containing dispersants or basic amines).

The amine salts of the thiophosphorus acid esters may be formed from ammonia, or a primary, secondary or tertiary amine, a dispersant or mixtures thereof. These amines can be monoamines or polyamines. Useful amines include those disclosed in U.S. Pat. No. 4,234,435 at Col. 21, line 4 to Col. 27, line 50, this section of this reference being incorporated herein by reference.

The monoamines generally contain from 1 to about 24 carbon atoms, with from 1 to about 12 carbon atoms being preferred, with from 1 to about 6 being more preferred. Examples of monoamines include methylamine, ethylamine, propylamine, butylamine, octylamine, and dodecylamine. Examples of secondary amines include dimethylamine, diethylamine, dipropylamine, dibutylamine, methylbutylamine, ethyl-hexylamine, etc. Tertiary amines include trimethylamine, tributylamine, methyldiethylamine, ethyldibutylamine, etc.

In one embodiment, the amine may be a hydroxyhydrocarbylamine. Typically, the hydroxyamines are primary, secondary or tertiary alkanolamines or mixtures thereof. Such amines can be represented by the formulae: $H_2$—N—R'—OH, H($R'_1$)N—R'—OH, and $(R'_1)_2$—N—R'—OH, wherein each R' is independently a hydrocarbyl group having from one to about eight carbon atoms or hydroxyhydrocarbyl group having from one to about eight carbon atoms, or from one to about four, and R' is a divalent hydrocarbyl group of about two to about 18 carbon atoms, or from two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group. Examples of these alkanolamines include mono-, di-, and triethanolamine, diethylethanolamine, ethylethanolamine, butyldiethanolamine, etc.

The hydroxyhydrocarbylamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of one or more of the above epoxides with above described amines and may be represented by the formulae: $H_2N—(R'O)_x—H$, $H(R'_1)N—(R'O)_x—H$, and $(R'_1)_2N—(R'O)_x—H$, wherein x is a number from about 2 to about 15 and $R_1$ and R' are as described above. $R'_1$ may also be a hydroxypoly(hydrocarbyloxy) group.

In another embodiment, the amine is a hydroxyhydrocarbylamine which may be represented by the formula

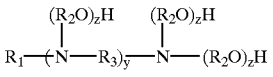

wherein $R_1$ is a hydrocarbyl group containing from about 6 to about 30 carbon atoms; $R_2$ is an alkylene group having from about two to about twelve carbon atoms, preferably an ethylene or propylene group; $R_3$ is an alkylene group containing from 1 up to about 8, or from 1 up to about 5 carbon atoms; y is zero or one; and each z is independently a number from zero to about 10, with the proviso that at least one z is zero.

Useful hydroxyhydrocarbyl amines where y in the formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethylhexylamine.

In one embodiment, the amine may be a hydroxyhydrocarbyl amine, where referring to the above formula, y equals zero. These hydroxyhydrocarbyl amines are available from the Akzo Chemical Division of Akzona, Inc., Chicago, Ill., under the general trade designations "ETHOMEEN" and "PROPOMEEN". Specific examples of such products include: ETHOMEEN C/15 which is an ethylene oxide condensate of a coconut fatty acid containing about 5 moles of ethylene oxide; ETHOMEEN C/20 and C/25 which are ethylene oxide condensation products from coconut fatty acid containing about 10 and 15 moles of ethylene oxide, respectively; ETHOMEEN O/12 which is an ethylene oxide condensation product of oleyl amine containing about 2 moles of ethylene oxide per mole of amine; ETHOMEEN S/15 and S/20 which are ethylene oxide condensation products with stearyl amine containing about 5 and 10 moles of ethylene oxide per mole of amine, respectively; ETHOMEEN T/12, T/15 and T/25 which are ethylene oxide condensation products of tallow amine containing about 2, 5 and 15 moles of ethylene oxide per mole of amine, respectively; and PROPOMEEN O/12 which is the condensation product of one mole of oleyl amine with 2 moles propylene oxide.

The amine may also be a polyamine. The polyamines include alkoxylated diamines, fatty polyamine diamines, alkylenepolyamines, hydroxy containing polyamines, condensed polyamines, and heterocyclic polyamines. Commercially available examples of alkoxylated diamines include those amines where y from above is one. Examples of these amines include ETHODUOMEEN T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are DUOMEEN C (N-coco-1,3-diaminopropane), DUOMEEN S (N-soya-1,3-diaminopropane), DUOMEEN T (N-tallow-1,3-diaminopropane), and DUOMEEN O (N-oleyl-1,3-diaminopropane). "DUOMEENS" are commercially available from Armak Chemical Co., Chicago, Ill.

The amine may be an alkylenepolyamine. Alkylenepolyamines are represented by the formula $H(R_1)N-(Alkylene-N)_n—(R_1)_2$, wherein each R1 is independently hydrogen; or an aliphatic or hydroxy-substituted aliphatic group of up to about 30 carbon atoms; n is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, R1 is independently a hydrocarbyl group having from one to about eight carbon atoms or hydroxyhydrocarbyl group having from one to about eight, or from one to about four carbon atoms. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl) amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms". These alkylenepolyamine bottoms include cyclic condensation products such as piperazine and higher analogs of diethylenetriamine, triethylenetetramine and the like.

In another embodiment, the polyamines are hydroxy-containing polyamines. Hydroxy-containing polyamine analogs of the hydroxy monoamines, particularly alkoxylated alkylenepolyamines, e.g., N,N'-(dihydroxyethyl) ethylenediamines can also be used. Such polyamines can be made by reacting the above-described alkyleneamines with one or more of the above-described alkylene oxides. Similar alkylene oxide- alkanolamine reaction products may also be used such as the products made by reacting the above described primary, secondary or tertiary alkanolamines with ethylene, propylene or higher epoxide in a 1.1 to 1.2 molar ratio. Reactant ratios and temperatures for carrying out such reactions are known to those skilled in the art. Specific examples of hydroxy-containing polyamines include N-(2-hydroxyethyl)ethylenediamine, N,N'-bis(2-hydroxyethyl) ethylenediamine, 1-(2-hydroxyethyl)piperazine, mono (hydroxypropyl)-substituted tetraethylene-pentamine, N-(3-hydroxybutyl)tetramethylenediamine, etc. Higher homologs obtained by condensation of the above illustrated hydroxy-containing polyamines through amino groups or through hydroxy groups are likewise useful. Condensation through amino groups results in a higher amine accompanied by removal of ammonia, while condensation through the hydroxy groups results in products containing ether linkages accompanied by removal of water. Mixtures of two or more of any of the above described polyamines are also useful.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 or from two to about four carbon atoms. Examples of polyhydric amines include diethanolamine, triethanolamine, tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris (hydroxymethyl)aminomethane (THAM).

Polyamines which may react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms". The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO86/05501 and U.S. Pat. No. 5,230,714 (Steckel) which are incorporated by reference for its disclosure to the condensates and methods of making. A particularly useful amine condensate is prepared from HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and tris(hydroxymethyl) aminomethane (THAM).

In another embodiment, the polyamine is a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmor-pholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines may be used and include N-(2-hydroxyethyl)cyclohexylamine, 3-hydroxycyclo pentylamine, parahydroxyaniline, N-hydroxyethylpiperazine, and the like.

In another embodiment, the salts of the thiophosphorus acid esters are prepared by reacting the thiophosphorus acid ester with an amine dispersant. The amine dispersant may be prepared by reacting a hydrocarbyl-substituted carboxylic acylating agent with one or more of the above described polyamines. The hydrocarbyl group may be derived from a polyalkene and may have a number average molecular weight from about 500 to about 5000 or from about 700 to about 2500. The polyalkenes are prepared from olefins set containing from about 2 to about 12 carbon atoms, or from about 2 to about 8 carbon atoms. Preferred hydrocarbyl group is derived from a polyisobutylene. The hydrocarbyl-substituted carboxylic acylating agents may be monocarboxylic or dicarboxylic acylating agents such as those derived from the reaction product of a polyalkene with a monocarboxylic acid such as acrylic acid, methacrylic o acid, itaconic acid, etc or reaction with a dicarboxylic acid such as maleic anhydride, maleic acid, fumaric acid, etc. These dispersants are described in U.S. Pat. No. 3,219,666 and U.S. Pat. No. 4,234,435, the disclosures of which are incorporated by reference for their teachings of hydrocarbyl-substituted carboxylic acylating agents, amines and methods of preparing the dispersants.

The following Examples relates to thiophosphorus acid esters and their salts, as well as methods of making the same. Unless the context clearly indicates otherwise, the weight and the ratio are by weight, temperature is in degrees Celsius, and the pressure is atmospheric.

EXAMPLE 1

(a) A reaction vessel is charged with 705 grams (2.1 moles) of a polyethoxylated secondary $C_{11-15}$ alcohol, having an average of 3 oxyethylene groups and available commercially as TERGITOL® 15-S-3, and 177 grams (1.1 moles) of triethylphosphite. The mixture is heated to 135° C. and the temperature is maintained for 5 hours, while 43 grams of distillate are collected. The temperature is gradually raised to 190° over 8 hours, while 33 grams of distillate are collected. The reaction mixture is cooled to 150° C. and vacuum stripped to 200 mm Hg. The temperature is raised to 190° C. and the pressure is reduced to 35 mm Hg. A total of approximately 100 grams of distillate is collected. The residue is cooled to 80° C. and filtered through diatomaceous earth. The residue contains 4.2% phosphorus.

(b) The above phosphite (319 grams, 0.43 equivalents) is charged to a reaction vessel and heated to 140° C. under a nitrogen flow of 0.4 standard cubic foot per hour (SCFH). Sulfur (11.5 grams, 0.36 equivalents) is added portionwise over 30 minutes to the reaction vessel, while maintaining the temperature at 140–145° C. The temperature is maintained for 2 hours at 145° C. The reaction mixture is cooled to 50° C. and filtered through diatomaceous earth. The filtrate has 4.0% phosphorus and 3.8% sulfur. The product has a 1B copper strip at 100° C. for 3 hours.

EXAMPLE 2

A reaction vessel is charged with the polyethoxylated alcohol of Example 1 (2500 grams, 7.53 equivalents) and triethylphosphite (626 grams, 3.77 equivalents). The reaction mixture is blown with nitrogen at less than 0.1 SCFH, and is heated to 145–150° C., while 148 grams of distillate are collected over 6–8 hours. The temperature is raised to 190° C. at a rate of approximately 10° C. per hour and is maintained for 1 hour, while additional distillate (105 grams) is collected. The reaction mixture is cooled to 160° C. and the reaction mixture is stripped to 200mm Hg at 160° C. for 2 hours. The temperature is raised to 190° C. and maintained for 1 hour, while the pressure is reduced to 35mm Hg. Vacuum is released and the residue is cooled to 135–140° C. Sulfur (100 grams, 3.13 equivalents) is added portionwise over 2 hours while maintaining the temperature between 135–145° C. The reaction mixture is heated to 145° C. and the temperature is maintained for 2 hours. The reaction mixture is cooled to 50° C. and the product is filtered through diatomaceous earth. The filtrate is the desired product, which has 4.2% phosphorus and 3.7% sulfur.

EXAMPLE 3

A reaction vessel is charged with 340 grams (0.67 equivalents) of a polyethoxylated secondary $C_{11-15}$ alcohol, and having an average of 7 oxyethylene groups, reacted with 56 grams (0.33 equivalents) of triethylphosphite. The reaction mixture is heated to 190° C. over 4 hours and a temperature is maintained at 190° C. for an additional 2 hours while 20 grams of distillate are collected. The reaction mixture is vacuum stripped to 25 mm at 190° C. for 1 hour, while 8 grams of distillate are collected. The residue is filtered through diatomaceous earth. The filtrate is the desired product and has 2.7% phosphorus and a 1A copper strip at 100° C. for 3 hours.

The above phosphite (0.43 equivalents) is reacted with (0.36 equivalents) of sulfur as described in Example 1.

EXAMPLE 4

A reaction vessel is charged with 400 grams (1.2 moles) of a polyethoxylated linear $C_{10-12}$ alcohol, having an average of 2.5 oxyethylene groups. Triethylphosphite (105 grams, 0.6 moles) is added to the reaction vessel and the mixture is heated to 145–150° C. The temperature is maintained for 3 hours under a sub-surface nitrogen inlet of less than 0.1 SCFH, while 25 grams of distillate are collected. The temperature is raised 100 per hour to a final temperature of 190°C. The temperature is maintained at 190° C. for 1 hour, while 41 grams of distillate are collected. The reaction mixture is cooled to 160° C. and vacuum stripped to 240 mm Hg at 190° C. The residue is cooled to 140° C. and the vacuum is released. Sulfur (17 grams, 0.53 equivalents) is added portionwise over 1 hour. The reaction temperature is maintained at 145° C. for 30 minutes. The reaction mixture is cooled and it is the desired product, which has 4.1 % phosphorus and 5.6% sulfur.

EXAMPLE 5

A reaction vessel is charged with 365 grams (2.2 moles) of triethylphosphite. The contents are heated to 130° C. where 664 grams of the polyethoxylated alcohol of Example 1 is added dropwise. When about 150 milliliters of the alcohol are added, the temperature is increased to 150° C. The addition is finished in four hours. The reaction temperature is maintained for eight hours. The reaction is vacuum stripped to 20 mm Hg and 135–140°C. A total of 200 grams of distillate is collected after vacuum. Sulfur (52 grams, 1.63 moles) is added over two hours at 145° C. The reaction temperature is maintained for two hours and contents are filtered through diatomaceous earth. The filtrate is the desired product and has 5.5% phosphorus and 6.0% sulfur.

EXAMPLE 6

A reaction vessel is charged with 1500 grams (4.5 moles) of the polyethoxylated alcohol of Example 1. The contents are heated to 180° C. where 250 grams (1.5 moles) of triethylphosphite is added dropwise over six hours. The reaction temperature is maintained at 180° C. for two hours. The reaction mixture was vacuum stripped to 20 mm Hg and 200° C. A total of 171 grams of distillate is collected. The reaction mixture is cooled to 135° C. and sulfur (43 grams, 1.34 moles) is added while keeping the temperature below 145° C. The reaction temperature is maintained for one hour at 145° C. and the contents are filtered through diatomaceous earth. The filtrate is the desired product and has 2.7% phosphorus and 2.6% sulfur.

EXAMPLE 7

A reaction vessel is charged with 450 grams (1.59 moles) of a ethoxylated branch chain primary $C_{9-11}$ alcohol, having an average of 2.5 oxyethylene groups and 134 grams (0.81 moles) of triethylphosphite. The mixture is heated to 150° C. and the temperature is maintained for 4 hours. The temperature is raised to 160°C. and the temperature is maintained for 1 hour. The reaction temperature is increased to 170° C. and the temperature is maintained for 3 hours. A total of 48 grams of distillate is collected. The reaction mixture is cooled to 140° C. The reaction mixture was vacuum stripped to 35 mm Hg at 170° C. Sulfur (20.7 grams, 0.65 equivalents) is added portionwise at 140–145° C. to the reaction vessel and the temperature maintained for 2 hours. The reaction mixture is cooled and the product contains 4.5% phosphorus and 4.9% sulfur.

EXAMPLE 8

A reaction vessel is charged with 300 grams (2.54 moles) of 2-butoxyethanol and 215 grams (1.3 equivalents) of triethylphosphite. The reaction mixture is heated to 135–140° C. and the temperature is maintained for 8 hours. The temperature is raised to 180° C. at a rate of 100 every hour. The reaction temperature is maintained at 2 hours and a total of 75 grams of distillate is collected. The reaction mixture is cooled to 170° C. and vacuum stripped at 200 mm Hg over 3 hours. The residue is cooled to room temperature.

The 375 grams (1.2 equivalents) of the above phosphite is added to a reaction vessel and heated to 140–145° C. Sulfur (36.5 grams, 1.1 equivalents) is added portionwise over 2 hours. The reaction temperature is maintained for 2 hours at 145° C. The product is cooled and decanted. The product contains 8.9% phosphorus and 9.6% sulfur.

EXAMPLE 9

A reaction vessel is charged with 811 grams (2.4 moles) of the polyethoxylated alcohol of Example 1, 337 grams (2.44 moles) of diethyl phosphite, and 3.0 grams of methylsulfonic acid (70%). The reaction mixture is heated to 145–150° C. under a nitrogen flow of 0.1 SCFH. The temperature is maintained for 5 hours while 56 grams of distillate are collected. The reaction mixture is vacuum stripped to 40 mm Hg at 150° C. while 80 grams of distillate are collected. The residue is cooled to 60° C. where 3.0 grams of sodium bicarbonate are added. The reaction mixture is filtered through diatomaceous earth at 40–50° C. and the filtrate is the desired product. The product has 7.8% phosphorus.

A reaction vessel is charged with the above phosphite (350 grams, 0.83 equivalents) and of a mixture of $C_{11-14}$ tertiary aliphatic primary amines (158 grams, 0.83 equivalents) available commercially as Primene 81R from Rohm & Haas Chemical Company. The mixture is heated to 120° C. where 22 grams (0.6 equivalents) of sulfur is added portionwise while maintaining the temperature at 120–125° C. The reaction temperature is maintained at 120–125° C. for 1 hour. The reaction temperature is increased to 150° C. and the temperature is maintained for 2 hours. The reaction mixture is cooled to room temperature and filtered through diatomaceous earth. The filtrate is the desired product and has 4.9% phosphorus and 4.0% sulfur.

EXAMPLE 10

The phosphite of Example 7 (257 grams, 0.61 moles) and 2-ethylhexylamine (69 grams, 0.52 moles) is added to a reaction vessel and heated to 85° C. Sulfur (16.6 grams, 0.52 equivalents) is added in portions over 90 minutes while maintaining the reaction temperature at 85–90° C. The reaction temperature is maintained for 2 hours at 90° C. The resulting product contains 5.1 % phosphorus, and 5.2% sulfur.

EXAMPLE 11

(a) A reaction vessel is charged with (700 grams, 2.1 moles) of the polyethoxylated alcohol of Example 1, (116 grams, 0.7 moles) of triethylphosphite and 0.5 grams of a 98% solution of sulfuric acid. The reaction mixture is heated to 140° C. and the temperature is maintained for 2 hours at 140–150° C. while 30 grams of distillate are collected. The temperature is raised to 190° C. over the next two hours and the temperature is maintained at 190° C. for two hours while 35 grams of distillate is collected. The reaction mixture is blown with nitrogen at 0.2 standard cubic feet per hour at 190° C. for 8 hours, while an additional 13 grams of distillate is collected. The reaction mixture is stripped to 190° C. and 200 mm Hg for 1 hour and then the pressure is reduced to 30 mm Hg. The residue is cooled and pressurized with nitrogen at 50° C. Sodium carbonate (one gram) is added to the residue and the mixture is stirred for 15 minutes. The mixture is filtered through diatomaceous earth. The filtrate is the desired product which has 2.7% phosphorus.

(b) The above product (550 grams, 0.5 moles) is added to a reaction vessel and heated to 140° C. Sulfur (13.9 grams, 0.4 moles) is added portionwise over 1 hour while maintaining the temperature at 140–145° C. The temperature is maintained for an additional hour at 145° C. The mixture is cooled to room temperature and decanted. The desired product contains 3.1% phosphorus and 3.1% sulfur.

Aqueous Compositions

The invention also includes aqueous compositions characterized by an aqueous phase with at least one thiophosphorus acid ester, or salt thereof dispersed or dissolved in said aqueous phase. The water-based functional fluids may be in the form of solutions; or micelle dispersions or microemulsions which appear to be true solutions. Preferably, the aqueous phase is a continuous aqueous phase although, in some embodiments, the aqueous phase may be a discontinuous phase.

These aqueous compositions usually contain at least about 25%, or at least about 40% by weight water. Such aqueous compositions encompass both concentrates containing about 25% to about 80% by weight, preferably from about 40% to about 65% water; and water-based functional fluids containing generally from about 25% to about 80%, or from about 40% to about 70% by weight of water. The concentrates generally contain less than about 50%, or less than about 25%, or less than about 15%, and or less than about 6% hydrocarbon oil.

These concentrates and water-based functional fluids can optionally include other conventional additives commonly employed in water-based functional fluids. These other additives include surfactants; thickeners; oil-soluble, water-insoluble functional additives such as antiwear agents, extreme pressure agents, dispersants, etc.; and supplemental additives such as corrosion-inhibitors, shear stabilizing agents, bactericides, dyes, water-softeners, odor masking agents, antifoam agents and the like.

The concentrates are analogous to the water-based functional fluids except that they contain less water and proportionately more of the other ingredients. The concentrates can be converted to water-based functional fluids by dilution with water. This dilution is usually done by standard mixing techniques. This is often a convenient procedure since the concentrate can be shipped to the point of use before additional water is added. Thus, the cost of shipping a substantial amount of the water in the final water-based functional fluid is saved. Only the water necessary to formulate the concentrate (which is determined primarily by ease of handling and convenience factors), need be shipped.

Generally these water-based functional fluids are made by diluting the concentrates with water, wherein the ratio of water to concentrate is usually in the range of about 80:20 to about 99:1 by weight. As can be seen when dilution is carried out within these ranges, the final water-based functional fluid contains, at most, an insignificant amount of hydrocarbyl oil.

Also included within the invention are methods for preparing aqueous systems, including both concentrates and water-based functional fluids, containing other conventional additives commonly employed in water-based functional fluids. These methods comprise the steps of:

(1) mixing the composition of the invention with such other conventional additives either simultaneously or sequentially to form a dispersion or solution; optionally (2) combining said dispersion or solution with water to form said aqueous concentrate; and/or (3) diluting said dispersion or solution, or concentrate with water wherein the total amount of water used is in the amount required to provide the desired concentration of the composition of the invention and other functional additives in said concentrates or said water-based functional fluids.

These mixing steps are carried out using conventional equipment and generally at room or slightly elevated temperatures, usually below 100° C. and often below 50° C. As noted above, the concentrate can be formed and then shipped to the point of use where it is diluted with water to form the desired water-based functional fluid. In other instances the finished water-based functional fluid can be formed directly in the same equipment used to form the concentrate or the dispersion or solution.

The dispersant/solubilizers that are useful in accordance with the present invention include the nitrogen-containing, phosphorus-free carboxylic solubilizers disclosed in U.S. Pat. Nos. 4,329,249; 4,368,133; 4,435,297; 4,447,348; and 4,448,703. These patents are incorporated herein by reference. Briefly, these dispersant/solubilizers are made by reacting (I) at least one carboxylic acid acylating agent having at least one hydrocarbyl-based substituent of at least about 12 to about 500 carbon atoms with (II) at least one (a) N-(hydroxyl-substituted hydrocarbyl) amine, (b) hydroxyl-substituted poly(hydrocarbyloxy) analog of said amine (a), or (c) mixtures of (a) and (b). Preferred acylating agents include the substituted succinic acids or anhydrides. Preferred amines include the primary, secondary and tertiary alkanolamines or mixtures thereof. These dispersant/solubilizers are preferably used at effective levels to disperse or dissolve the various additives, particularly the functional additives discussed below, in the concentrates and/or water-based functional fluids of the present invention. In a particularly preferred embodiment of the present invention, the dispersant/ solubilizer is the reaction product of a polyisobutenyl-substituted succinic anhydride with diethylenethanolamine or a mixture of diethylenethanolamine and ethanolamine.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, N.J., U.S.A., which is hereby incorporated by reference for its disclosures in this regard. Specific nonionic surfactant types include alkylene oxide treated products, such as ethylene oxide treated phenols and ethylene oxide/propylene oxide block copolymers, alcohols, esters, such as glycerol esters, amines, such as the above hydroxyamines, and amides. Examples of surfactants include alkylene oxide treated alkylphenols, sold commercially under the tradename of Triton® such as Triton® X-100, available commercially from Union Carbide Chemical Company; alkoxylated amines available from Akzo Chemie under the names ETHODUOMEEN® (polyethoxylated diamines), ETHOMEEN® (poly-ethoxylated aliphatic amines), ETHOMID® (polyethoxylated amides), and ETHOQUAD (polyethoxylated quaternary ammonium chlorides); tall oil acids, sold under the trade name Unitol DT/40 (available from Union Camp Corp); and the above described hydroxyalkyl amines.

Among the useful anionic surfactant types are the widely known carboxylate soaps, metal organosulfates, metal sulfonates, metal sulfonylcarboxylates, and metal phosphates. Useful cationic surfactants include nitrogen compounds such as amine oxides and the well-known quaternary ammonium salts. Amphoteric surfactants include amino acid-type materials and similar types.

Surfactants are generally employed in effective amounts to aid in the dispersal of the various additives, particularly in the functional additives discussed below of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 10% by weight of one or more of these surfactants.

Often the aqueous compositions of this invention contain at least one thickening agent. Generally, these thickening agents can be polysaccharides, including cellulose ethers and esters, such as hydroxyethyl cellulose and the sodium salt of carboxymethyl cellulose, synthetic thickening polymers, or mixtures of two or more of these. Specific examples of such gums are gum agar, guar gum, gum arabic, algin, dextrans, xanthan gum and the like. A thickener can also be synthetic thickening polymers. Representative of them are polyacrylates, polyacrylamides, hydrolyzed vinyl esters, water-soluble homo- and interpolymers of acrylamidoalkane sulfonates and other comonomers such as acrylonitrile, styrene and the like.

Preferred thickening agents include the water-dispersible reaction products formed by reacting (i) at least one hydrocarbyl-substituted succinic acid and/or anhydride wherein the hydrocarbyl group has from about 8 to about 40, or from about 12 to about 30, or from about 16 to about 24 carbon atoms, with (ii) at least one water-dispersible amine terminated poly(oxyalkylene) or (iii) at least one water-dispersible hydroxy-terminated polyoxyalkylene. Examples of water-dispersible amine-terminated poly(oxyalkylene)s that are useful in accordance with the present invention are disclosed in U.S. Pat. Nos. 3,021,232; 3,108,011; 4,444,566; and Re 31,522. The disclosures of these patents are incorporated herein by reference. Water-dispersible amine terminated poly(oxyalkylene)s that are useful are commercially available from the Texaco Chemical Company under the trade name Jeffamine®. Water-dispersible hydroxy-terminated polyoxyalkylenes are commercially available from BASF Wyandotte Corporation under the tradename "Tetronic" and "Pluronic". Useful hydroxy-terminated polyoxyalkylenes are disclosed in U.S. Pat. Nos. 2,674,619 and 2,979,528, which are incorporated herein by reference.

The reaction between the succinic acid and/or anhydride and the amine- or hydroxy-terminated polyoxyalkylene is described in U.S. Pat. No. 4,659,492 this patent is incorporated herein by reference for its teachings with respect to the use of the reaction product of a hydrocarbyl-substituted succinic acid or anhydride and hydroxy-terminated poly (oxyalkylene).

When the thickener is formed using an amine-terminated poly(oxyalkylene), the thickening characteristics of said thickener can be enhanced by combining it with at least one of the above surfactant. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is generally present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

The functional additives that may also be included in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. These additives can function in two or more of the above-mentioned ways; for example, extreme pressure agents often function as load-carrying agents.

The term "oil-soluble, water-insoluble functional additive" refers to a functional additive which is not soluble in water above a level of about 1 gram per 100 parts of water at 25° C., but is soluble in mineral oil to the extent of at least 1 gram per liter at 25° C. These functional additives may also include certain solid lubricants such as graphite, molybdenum disulfide and polytetrafluoroethylene and related solid polymers. These functional additives can also include frictional polymer formers, which form materials which are dispersed in a liquid are believed to polymerize under operating conditions. A specific example of such materials is dilinoleic acid and ethylene glycol combinations which can form a polyester frictional polymer film. These materials are known to the art and descriptions of them are found, for example, in the journal "Wear", Volume 26, pages 369–392, and West German Published Patent Application 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids. Typically such salts are of carboxylic acids of 1 to 22 carbon atoms including both aromatic and aliphatic acids; sulfur acids such as alkyl and aromatic sulfonic acids and the like; phosphorus acids such as phosphoric acid, phosphorus acid, phosphinic acid, acid phosphate esters and analogous sulfur homologs such as the thiophosphoric and dithiophosphoric acid and related acid esters; boron acids include boric acid, acid borates and the like. Useful functional additives also include metal dithiocarbamates such as molybdenum and antimony dithiocarbamates; as well as dibutyl tin sulfide, tributyl tin oxide, phosphates and phosphites; borate amine salts, chlorinated waxes; trialkyl tin oxide, molybdenum phosphates, and chlorinated waxes.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smallheer and R. K. Smith, The Lezius-Hiles Co., Cleveland, Ohio, U.S.A. These references are hereby incorporated by reference for their disclosures of functional additives useful in the compositions of this invention.

In certain of the typical aqueous systems of the invention, the functional additive is a sulfur or chloro-sulfur E.P. agent, known to be useful in oil-base systems. Such materials include chlorinated aliphatic hydrocarbons, such as chlorinated wax; organic sulfides and polysulfides, such as benzyldisulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate; phosphorus esters such as the dihydrocarbon and trihydrocarbon phosphites, i.e., dibutyl phosphite, diheptyl phosphite, dicyclohexyl phosphite, pentylphenyl phosphite, dipentylphenyl phosphite, tridecyl phosphite, distearyl phosphite and polypropylene substituted phenol phosphite; metal thiocarbamates, such as zinc dioctyldithiocarbamate and barium heptylphenol dithiocarbamate; and Group II metal salts of phosphorodithioic acid, such as zinc dicyclohexyl phosphorodithioate, and the zinc salts of a phosphorodithioic acid.

The functional additive can also be a film former such as a synthetic or natural latex or emulsion thereof in water. Such latexes include natural rubber latexes and polystyrene-butadienes synthetic latex.

The functional additive can also be an anti-chatter or anti-squawk agent. Examples of the former are the amide-metal dithiophosphate combinations such as disclosed in West German Patent 1,109,302; amine salt-azomethene combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure to anti-chatter and anti-squawk agents.

Typically, the functional additive is present in a functionally effective amount. The term "functionally effective amount" refers to a sufficient quantity of an additive to impart desired properties intended by the addition of said additive.

The aqueous systems of this invention often contain at least one optional inhibitor for corrosion of either ferrous or non-ferrous metals or both. The inhibitor can be organic or inorganic in nature. Included are those described in "Protective Coatings for Metals" by Burns and Bradley, Reinhold Publishing Corporation, Second Edition, Chapter 13, pages 596–605, the disclosure of which relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Specific examples of organic inhibitors include hydrocarbyl amine and hydroxy-substituted hydrocarbyl amine neutralized acid compounds, such as neutralized phosphates and hydrocarbyl phosphate esters, neutralized fatty acids, neutralized aromatic carboxylic acids (e.g., 4-tertiarybutyl benzoic acid), neutralized naphthenic acids and neutralized hydrocarbyl sulfonates. Particularly useful amines include the alkanolamines such as ethanolamine, diethanolamine.

The aqueous systems of the present invention can also include at least one bactericide. Such bactericides are well known to those of skill in the art and specific examples can be found in the aforementioned McCutcheon publication "Functional Materials" under the heading "Antimicrobials" on pages 9–20 thereof. This disclosure is hereby incorporated by reference as it relates to suitable bactericides for use in the aqueous compositions or systems of this invention.

The aqueous systems of the present invention can also include such other materials as dyes, e.g., an acid green dye; water softeners, e.g., ethylene-diaminetetraacetate sodium salt or nitrilotriacetic acid; odor masking agents, e.g., citronella, oil of lemon; antifreeze additive, e.g., ethylene glycol, propylene glycol, and analogous polyoxyalkylene polyols; and antifoamants, such as the well-known silicone antifoamant agents.

Discussion of aqueous compositions and components of aqueous systems occurs in U.S. Pat. No. 4,707,301, herein incorporated by reference for its disclosure of aqueous compositions and components of aqueous compositions.

The following examples relate to aqueous concentrates containing thiophosphorus acid esters and salts thereof. The products are made by blending. The surfactant is Triton® X-100 (alkylene oxide treated alkyl phenol) and the dispersing agent is a reaction product of diethylethanol amine and polyisobutenyl (Mn=950)-substituted succinic anhydride. The balance of each of the concentrates is made up of 100 neutral mineral oil.

TABLE 1

| | A | B | C | D | E | F | G | H |
|---|---|---|---|---|---|---|---|---|
| Product of Ex 2 | 5 | 2 | 8 | — | — | — | 5 | — |
| Product of Ex 9 | — | — | — | 5 | 0 | 5 | — | 5 |
| Dispersing Agent | 17 | 12 | 8 | 17 | 12 | 8 | — | — |
| Surfactant | — | — | — | — | — | — | 12 | 10 |
| Diluent Oil | Bal. | Bal. | Bal. | Bal. | Bal. | Bal. | Bal. | Bal. |

Each of the above concentrates may be blended with water to form aqueous compositions. The products are diluted on a ratio of 20 parts water to 1 part concentrate.

The following examples relate to aqueous compositions containing the thiophosphorus acid esters and salts thereof. The examples are prepared by mixing the components in a homogenizer.

| | J | K |
|---|---|---|
| 100 neutral mineral oil | 4.0 | 4.0 |
| Water | 95.0 | 95.0 |
| Reaction product of diethylethanolamine and a polybutenyl-(Mn = 950)-substituted succinic anhydride | 0.8 | 0.8 |
| Product of Example 2 | 0.1 | — |
| Product of Example 10 | — | 0.15 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An aqueous composition comprising water, a dispersant/solubilizer or a nonionic surfactant, and at least one metal-free thiophosphorus acid ester, at least one amine salt of the thiophosphorus acid ester, or a mixture thereof, wherein the thiophosphorus acid ester contains at least one hydrocarbyl terminated polyoxyalkylene group, the hydrocarbyl moiety of the hydrocarbyl terminated polyoxyalkylene group containing about 6 to about 30 carbon atoms, the oxyalkylene moiety of the hydrocarbyl terminated polyoxyalkylene group containing about 2 to about 8 carbon atoms, and the hydrocarbyl terminated polyoxyalkylene group containing about 2 to about 40 oxyalkylene moieties.

2. The composition of claim 1 wherein the hydrocarbyl moiety is selected from butyl, octyl, dodecyl, stearyl, and oleyl.

3. The composition of claim 1 wherein the oxyalkylene moiety is selected from oxyethylene, oxypropylene, oxybutylene, and mixtures thereof.

4. The composition of claim 1 wherein the hydrocarbyl terminated polyoxyalkylene group contains from 2 to about 12 oxyalkylene moieties.

5. The composition of claim 1 wherein the thiophosphorus acid ester has at least two hydrocarbyl terminated polyoxyalkylene groups.

6. The composition of claim 1 wherein the salt of the thiophosphorus acid ester is derived from at least one amine.

7. The composition of claim 6 wherein the amine is at least one tertiary aliphatic primary amine or a branched secondary amine.

8. The composition of claim 1 wherein the lubricating composition further comprises at least one sulfur compound, at least one phosphorus or boron containing antiwear or extreme pressure agent or mixtures thereof.

9. The composition of claim 1, wherein the surfactant is selected from a polyoxyalkylene amine, a polyoxyalkylene amide, a polyoxyalkylene alcohol, a polyoxyalkylene phenol, a polyoxyalkylene ether, a polyoxyalkylene ester, or mixtures thereof.

10. An aqueous composition comprising water, a dispersant/solubilizer or a nonionic surfactant and at least one amine salt of at least one metal-free monothiophosphorus acid ester containing at least one hydrocarbyl terminated polyoxyalkylene group, the hydrocarbyl moiety of the hydrocarbyl terminated polyoxyalkylene group containing about 6 to about 30 carbon atoms, the oxyalkylene moiety of the hydrocarbyl terminated polyoxyalkylene group containing about 2 to about 8 carbon atoms, and the hydrocarbyl terminated polyoxyalkylene group containing about 2 to about 40 oxyalkylene moieties.

11. The composition of claim 10, wherein the surfactant is selected from a polyoxyalkylene amine, a polyoxyalkylene amide, a polyoxyalkylene alcohol, a polyoxyalkylene phenol, a polyoxyalkylene ether, a polyoxyalkylene ester, or mixtures thereof.

12. An aqueous composition comprising water, a dispersant/solubilizer or a nonionic surfactant, and at least one metal-free thiophosphorus acid ester represented by the following formula $$(R_1\text{—}(OR_2)_x\text{—}X_2)_{3-a}\text{—}\overset{\overset{X_1}{\|}}{P}\text{—}(X_3R_3)_a$$

wherein $X_1$ and $X_3$ are oxygen or sulfur, provided that at least one of $X_1$ and $X_3$ is sulfur; $X_2$ is oxygen; $R_1$ is a hydrocarbyl group of about 6 to about 30 carbon atoms; $R_2$ is an alkylene group of about 2 to about 8 carbon atoms; $R_3$ is a hydrogen or hydrocarbyl group; x is a number from about 2 to about 40; and a is 0, 1, or 2, or at least one salt of the thiophosphorus acid ester.

13. The composition of claim 12 wherein $X_1$ is sulfur, and $X_2$ and $X_3$ are oxygen, and a is 0 or 1.

14. The composition of claim 12 wherein x is a number from 2 to about 10.

15. The composition of claim 12 wherein the salt is at least one amine salt and $R_3$ is hydrogen.

16. The composition of claim 12 wherein the aqueous composition is a metal working fluid, or a hydraulic fluid.

17. The composition of claim 12, wherein the surfactant is selected from a polyoxyalkylene amine, a polyoxyalkylene amide, a polyoxyalkylene alcohol, a polyoxyalkylene phenol, a polyoxyalkylene ether, a polyoxyalkylene ester, or mixtures thereof.

18. The composition of claims 17 wherein the composition is a water-base hydraulic fluid or metal working fluid.

19. An aqueous composition as in claim 1, wherein the dispersant/solubilizer is the reaction product of (I) at least one carboxylic acid acylating agent having at least one hydrocarbyl-based substituent of at least about 12 to about 500 carbon atoms with (II) at least one (a) N-(hydroxyl-substituted hydrocarbyl) amine, (b) hydroxyl-substituted poly(hydrocarbyloxy) analog of said amine (a), or (c) mixtures of (a) and (b).

20. An aqueous composition as in claim 19, wherein the acylating agent is a substituted succinic acid or anhydride.

21. An aqueous composition as in claim 19, wherein the amine is a primary, secondary or tertiary alkanolamine or mixtures thereof.

22. An aqueous composition as in claim 19, wherein the dispersant/solubilizer is the reaction product of a polyisobutenyl-substituted succinic anhydride with diethylenethanolamine or a mixture of diethylenethanolamine and ethanolamine.

23. An aqueous composition as in claim 12, wherein the dispersant/solubilizer is the reaction product of (I) at least one carboxylic acid acylating agent having at least one hydrocarbyl-based substituent of at least about 12 to about 500 carbon atoms with (II) at least one (a) N-(hydroxyl-substituted hydrocarbyl) amine, (b) hydroxyl-substituted poly(hydrocarbyloxy) analog of said amine (a), or (c) mixtures of (a) and (b).

24. An aqueous composition as in claim 23, wherein the acylating agent is a substituted succinic acid or anhydride.

25. An aqueous composition as in claim 23, wherein the amine is a primary, secondary or tertiary alkanolamine or mixtures thereof.

26. An aqueous composition as in claim 23, wherein the dispersant/solubilizer is the reaction product of a polyisobutenyl-substituted succinic anhydride with diethylenethanolamine or a mixture of diethylenethanolamine and ethanolamine.

* * * * *